US005907931A

United States Patent [19]

Sun

[11] Patent Number: 5,907,931

[45] Date of Patent: Jun. 1, 1999

[54] SPHERICAL STRUCTURE AND METHOD FOR FORMING THE SAME BASED ON FOUR BASIC ELEMENT

[75] Inventor: En-Yuan Sun, Taoyuan, Taiwan

[73] Assignee: Chung Shan Institute of Science & Technology, Taoyuan, Taiwan

[21] Appl. No.: 09/021,403

[22] Filed: Feb. 10, 1998

[51] Int. Cl.[6] ..... E04B 7/10

[52] U.S. Cl. ..... 52/81.4; 52/81.1; 52/81.2; 52/DIG. 10

[58] Field of Search ..... 52/81.1, 81.4, 52/81.2, 652.1, 648.1, DIG. 10

[56] References Cited

U.S. PATENT DOCUMENTS 3,154,887 11/1964 Schmidt ..... 52/52
3,392,495 7/1968 Ahern et al. ..... 52/81
4,026,078 5/1977 Ahern et al. ..... 52/81

*Primary Examiner*—Carl D. Friedman
*Assistant Examiner*—Nkeisha J. Maddox
*Attorney, Agent, or Firm*—Bacon & Thomas

[57] ABSTRACT

A spherical structure is formed by assembling a plurality of elementary constructs each of which is composed of three first triangular elements, three second triangular elements, three third triangular elements, and three fourth triangular elements. These triangular basic elements are different-sized triangular frameworks covered by respectively corresponding panels. A self-supporting spherical radome or other spherical structures can be constructed from a random distribution of these four basic elements by repeatedly arranging the elementary constructs assembled by the basic elements. Only four different triangular basic elements are required for constructing and dovetailing the whole spherical structure.

4 Claims, 7 Drawing Sheets

SPHERICAL STRUCTURE AND METHOD FOR FORMING THE SAME BASED ON FOUR BASIC ELEMENT

BACKGROUND OF THE INVENTION

There are many possible patterns for the arrangement of the frame construction of a self-supporting spherical enclosure. Serving as a radome, both the structural factors and its effects to the electromagnetic waves should be taken into account when developing a spherical enclosure, and the frame construction must be randomly distributed for electricity sake; however, the number of its basic elements is preferably reduced when considering the costs of material preparation and element construction. Therefore, arranging the frame construction becomes highly perplexing as being limited by its mechanical structure and its effects to the electromagnetic waves. FIG. 6 is a schematic diagram of a spherical radome structure.

A prior construction is disclosed in the U.S. Pat. No. 3,392,495 wherein twenty large spherical equilateral triangular sections construct a sphere, and nineteen small triangular basic elements with their corresponding panels compose one equilateral triangular section. Five different kinds of small triangular basic elements are required when converting the inner large planar equilateral triangular sections into the outer large spherical equilateral triangular sections, as seen in FIG. 7. Another improved frame construction is disclosed in the U.S. Pat. No. 4,026,078 in which only thirteen small triangular basic elements with their corresponding panels are necessary for each large spherical equilateral triangular section, and only four different kinds of small triangular basic elements are required (FIG. 8).

SUMMARY OF THE INVENTION

Therefore, the object of the present invention is to provide an improved arrangement of the frame construction for a spherical structure composed of plural elementary constructs, thereby simplifies the assembling process and reduces the cost of the whole structure.

The elementary construct according to the present invention is characterized in that the number of the triangular basic elements needed for each large spherical equilateral triangular section is reduced to twelve, and only four different kinds of triangular basic elements are required. Therefore, the total number of the triangular frames, panels, and apexes needed for constructing a spherical structure can be further lessened, thereby reduces the cost for manufacturing, transferring, constructing, and inspecting the structure.

The differences between the present invention and the prior arts are listed below:

| | U.S. Pat. No. 3,392,495 | U.S. Pat. No. 4,026,078 | The present invention |
|---|---|---|---|
| number of basic elements for an elementary constructs | 19 | 13 | 12 |
| kinds of basic elements required | 5 | 4 | 4 |

DESCRIPTION OF THE PREFERRED EMBODIMENT

Disregarding its influence to the electromagnetic waves, a spherical structure can easily be constructed by regularly arranging uniformly-sized triangular elements. For example, a sphere can be divided into 20 identical equilateral triangles, and each equilateral triangle can be further partitioned into smaller triangles by cutting through the midpoint of each side of the equilateral triangle; such partitioning process is proceeded until a proper size is obtained. However, as been utilized for covering a radar, some strong unwanted reflections may easily occurred in particular directions when a spherical structure is constructed by regularly arranging the basic elements, which interferes the reception of electromagnetic waves. Therefore, regular arrangement is not suitable for the designation of a radome. The arrangement of the element construction of a spherical structure must be carefully developed according to the structural factors, the fabricating costs, and its effects to the electromagnetic waves.

Figure 6:
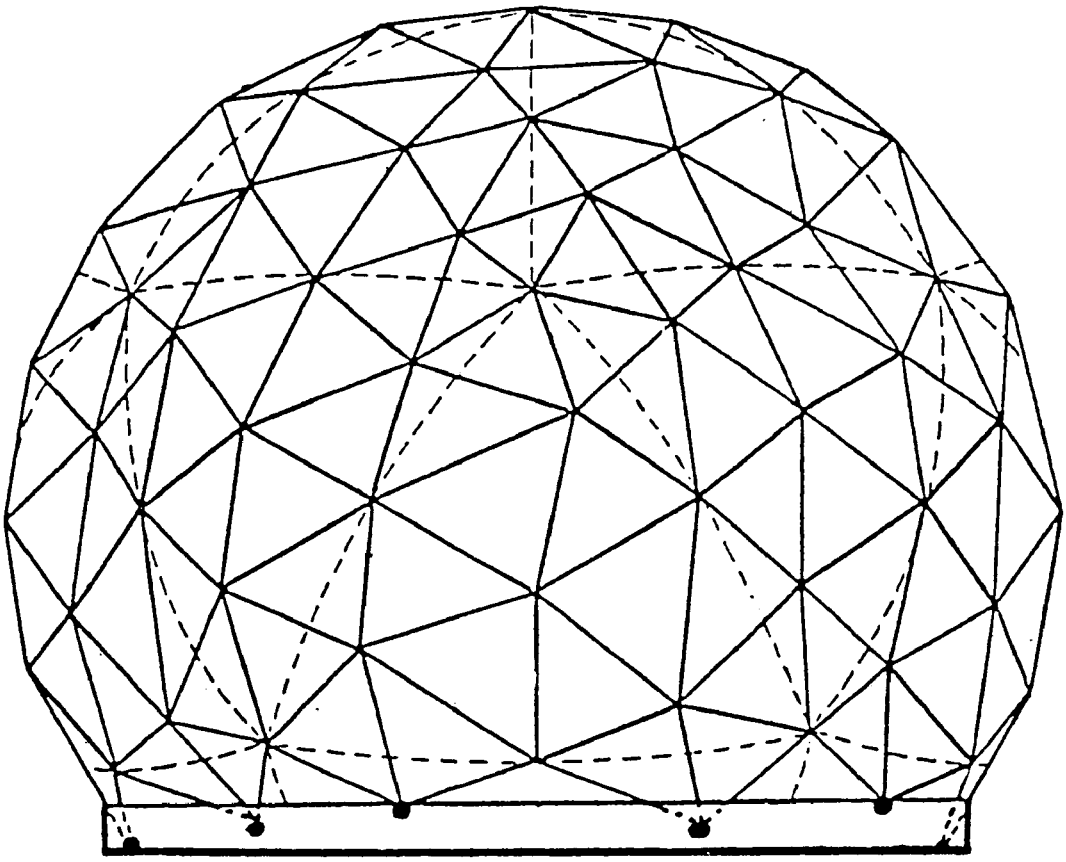
FIG. 6 is the complete schematic diagram of the frame construction for a radome structure.
Figure 7:
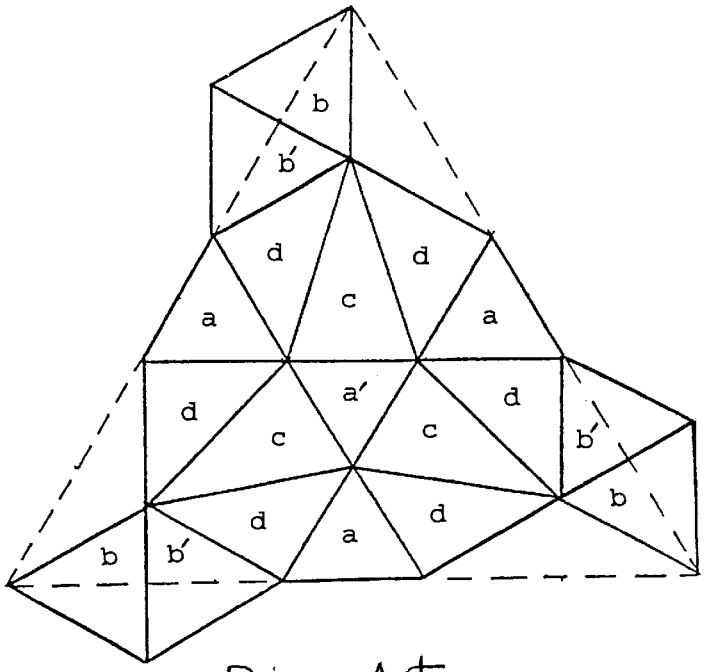
Prior Art Fig. 7
FIG. 7 shows the diagrammatic view of a large spherical equilateral triangular section established in accordance with the U.S. Pat. No. 3,392,495.
Figure 8:
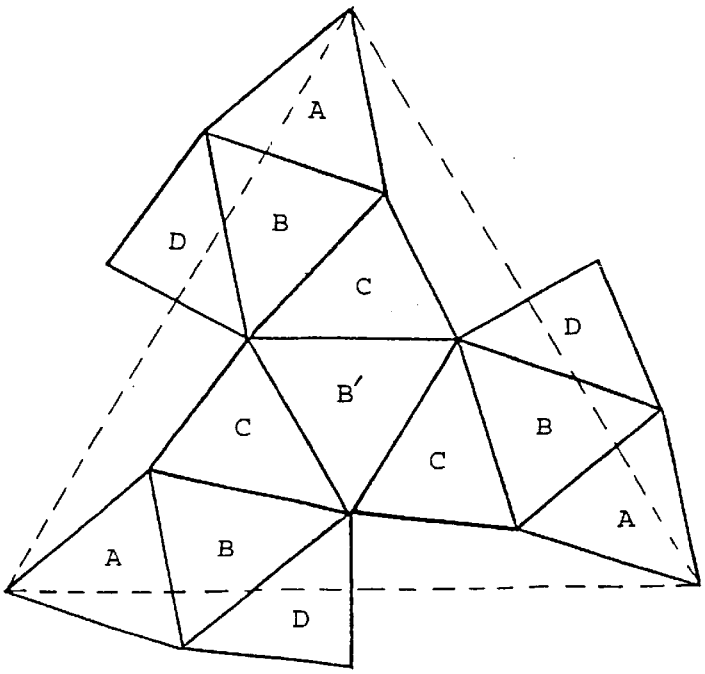
Prior Art Fig. 8
FIG. 8 shows the diagrammatic view of a large spherical equilateral triangular section established in accordance with the U.S. Pat. No. 4,026,078.

FIG. 6 shows a complete schematic diagram of the element construction for a self-supporting spherical radome or a similar spherical structure disposed on a circular base. As seen in FIG. 6, the whole spherical structure is constructed by many randomly arranged triangular basic elements, and the orthographic view of the arrangement of these triangles is shown. A random arrangement of these basic elements is essential if the radar equipment within the radome is to function properly.

There should be some simple rules and recurrences to be followed when fabricating and assembling the spherical structure, thereby reducing the cost and simplifies the processing procedure. Considering the large spherical equilateral triangular sections separated by the dashed lines shown in FIG. 6, one can found that each large spherical equilateral triangular section and the small triangular basic elements disposed thereon are corresponded to each other. This globally regular, locally random arrangement is characterized in that the basic elements are randomly distributed over the corresponding area of a radome on any direction within the effective radius of a radar, thereby the operation of radar is not seriously interfered; and that the number of kinds of different-sized basic elements are reduced, thereby the fabricating and assembling can be easily proceeded and the cost is greatly lowered.

Figure 1:
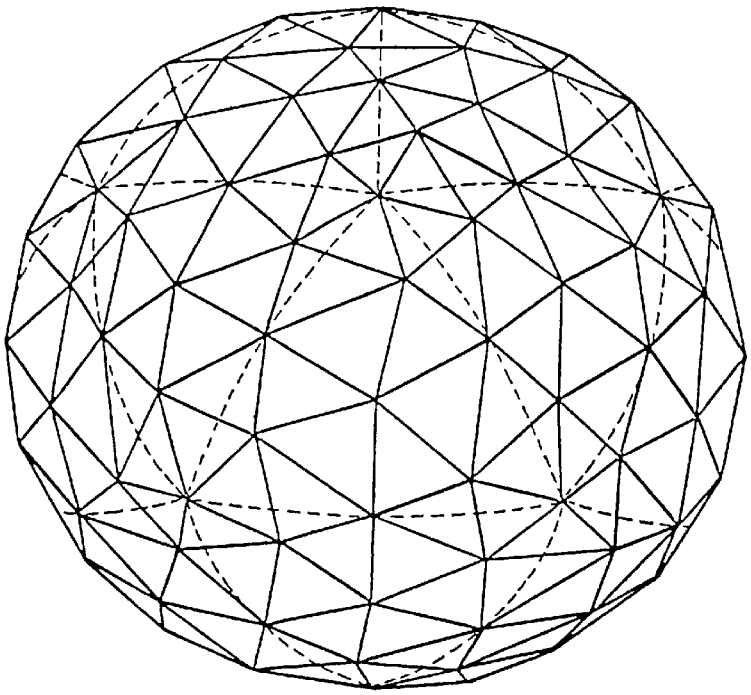
FIG. 1 is a schematic diagram showing the arrangement of the basic elements on a sphere according to the present invention.
Figure 2:
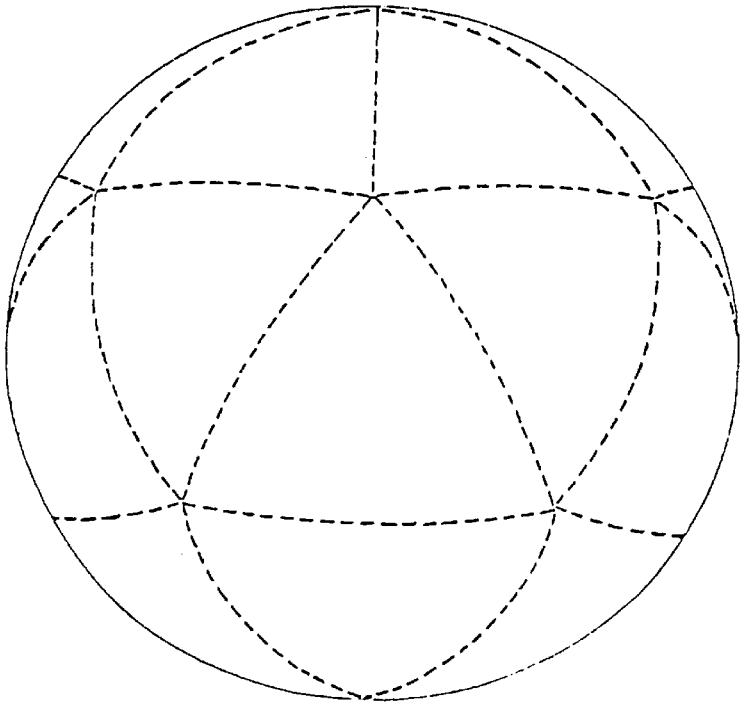
FIG. 2 is a partitioning schematic diagram showing the spherical structure which has been divided into twenty large spherical equilateral triangular sections.

According to the preferred embodiment of the present invention, a spherical surface is first divided into twenty identical large spherical equilateral triangles as shown in FIG. 2, and an elementary construct of the spherical structure is made up in accordance with one of these large spherical equilateral triangles. A spherical structure is thus built up by arranging a plurality of the elementary constructs, as seen in FIG. 1. After truncating the bottom of the spherical structure and further processing, a practical frame-structured radome structure is obtained, as shown in FIG. 6.

Figure 3:
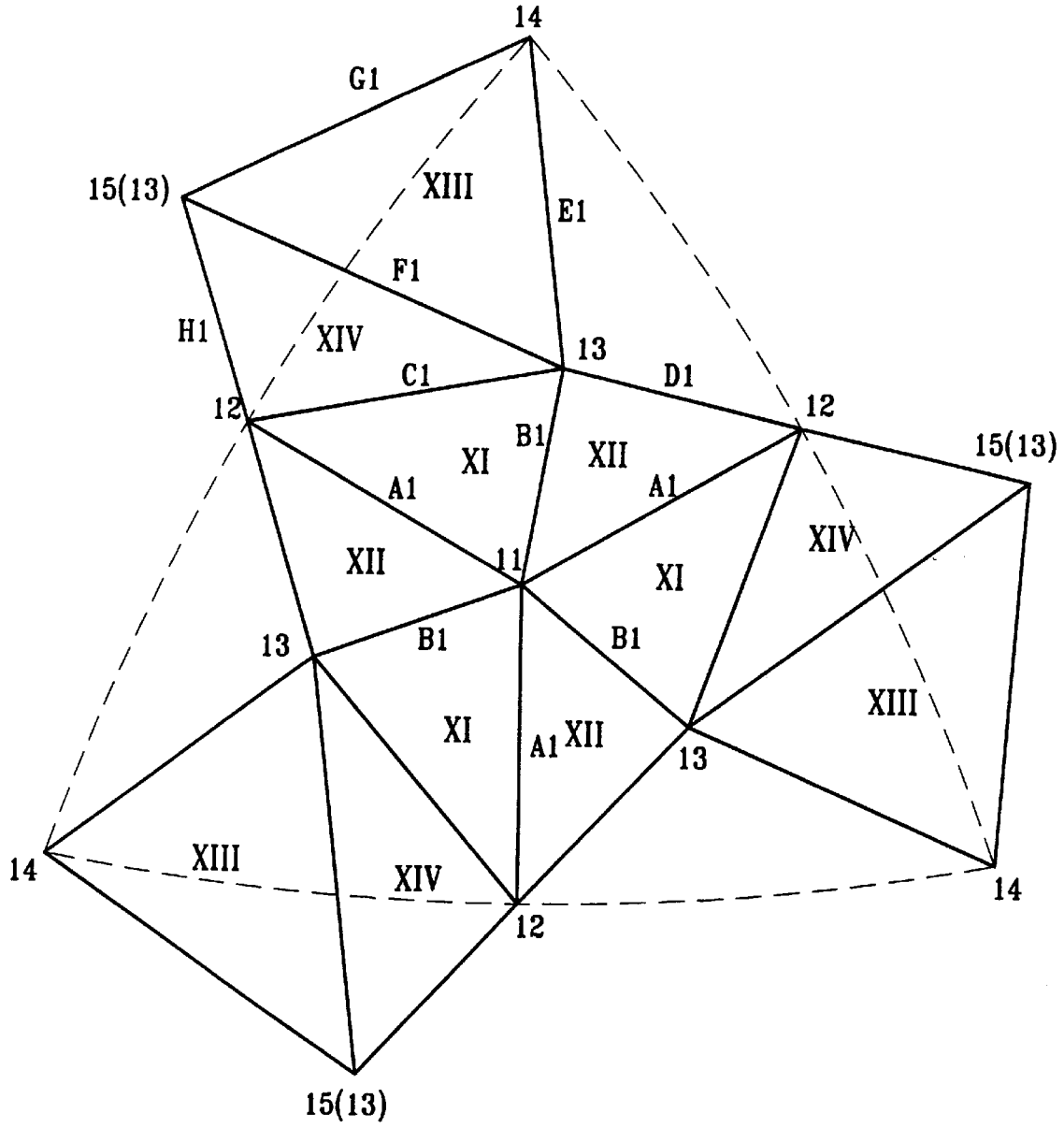
FIG. 3 shows the diagrammatic view of a large spherical equilateral triangular section according to the present invention.
Figure 4A:
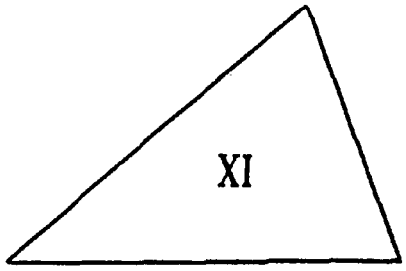
FIGS. 4A–4D show the four triangular basic elements and their relative sizes and shape in accordance with the large spherical equilateral triangular section shown in FIG. 3.
Figure 4B:
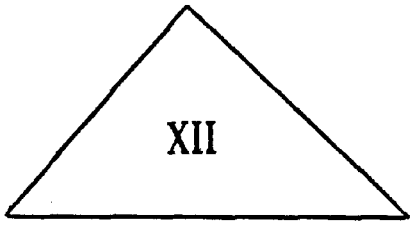
Figure 4C:
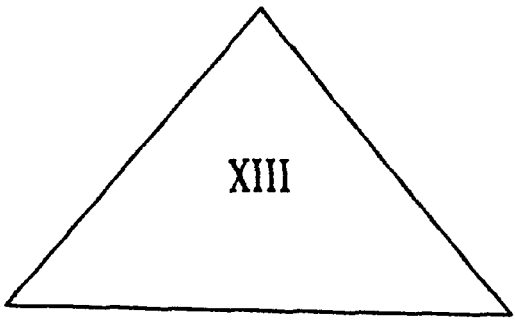
Figure 4D:
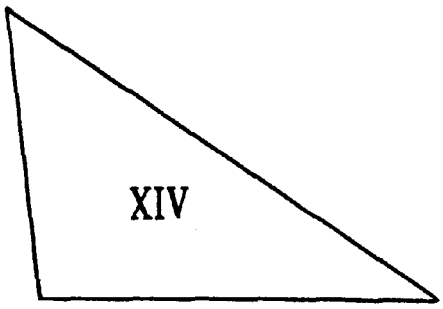

FIG. 3 shows the diagrammatic view of a large spherical equilateral triangular section according to the present invention, while the four triangular basic elements and their relative sizes and shape in accordance with the large spherical equilateral triangular section are shown in FIGS. 4A–4D.

Figure 5A:
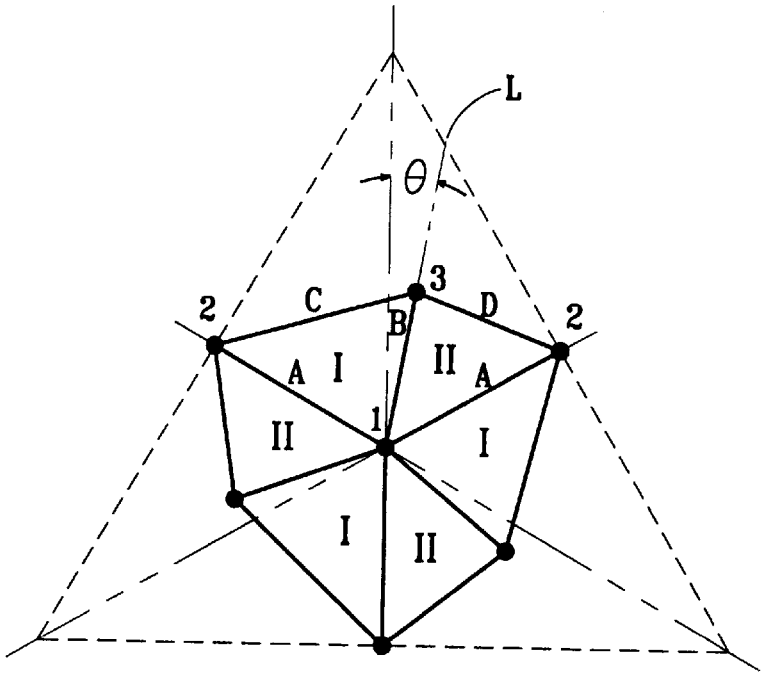
FIGS. 5A–5C are diagrammatic views illustrating the successive steps for establishing the elementary constructs shown in FIG. 3 using the four triangular basic elements.
Figure 5B:
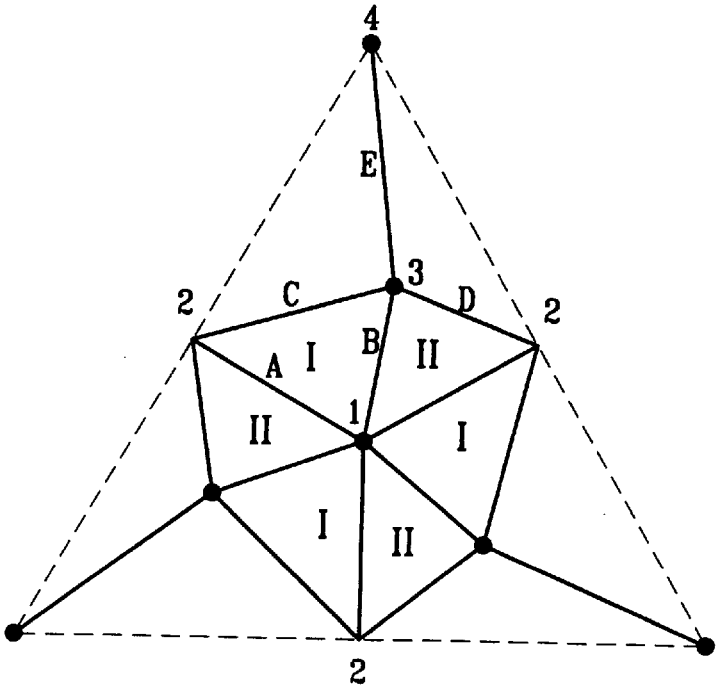
Figure 5C:
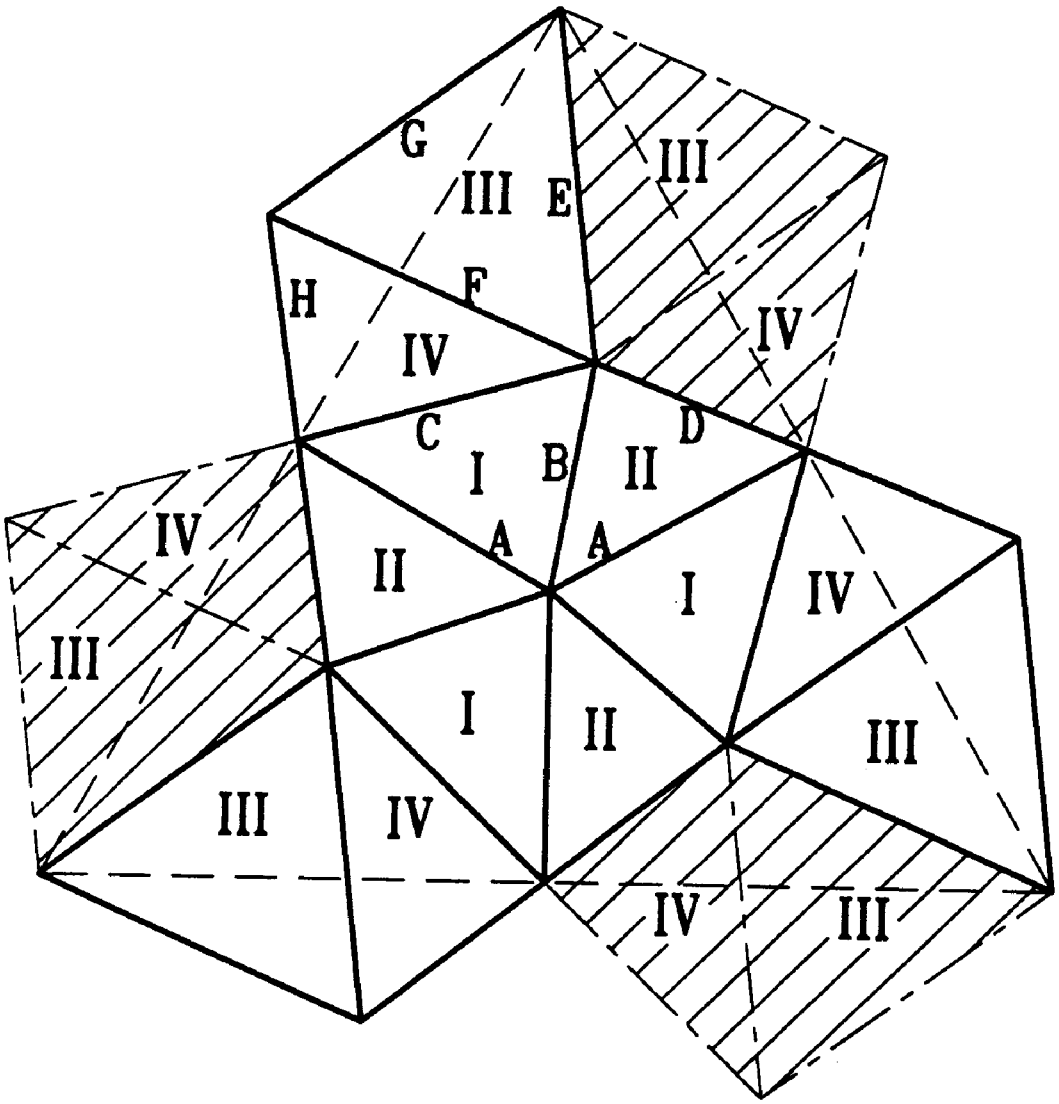

FIG. 5C shows the projective planar pattern of an elementary construct (shown in FIG. 3) and parts of its contiguous neighbors (shadowed areas). The line G of the first elementary construct overlaps with the line E of a contiguous second elementary construct, and the line H of the first elementary construct overlaps with the line F of the second elementary construct, thereby the plural elementary constructs can be firmly assembled to form a fixed spherical structure. Since each of the elementary constructs comprises only four different triangles, the spherical structure can be easily built up by repeatedly arranging the corresponding triangular elements of these triangles.

The detailed description of the elementary constructs will be illustrated hereinafter. The three apexes of a large spherical equilateral triangle is connected to form a corresponding large planar equilateral triangle (dotted line in FIG. 5A). Three lines A are formed by connecting the point 1 to each of the three points 2, wherein the point 1 is the mass center of the large planar equilateral triangle, and each of the points 2 is the midpoint of each side of this equilateral triangle.

Using the point 1 as a rotary center, the assistant line L can be drawn by rotating the line A with a (60+θ) angle clockwise, a point 3 is located on the assistant line L with a predetermined distance to the point 1. The other two points 3 can also be derived in this way. Three lines B are formed by connecting the point 1 to each of the points 3. Three identical triangles I can be defined from lines A, their corresponding lines B, and the angles (60+θ) therebetween, wherein the third sides of these triangles I are lines C. The two ends of line C are point 2 and point 3, while the three apexes of the triangle I are point 1, point 2, and point 3 (clockwise). Considering the gross effect to the structural and electric characters (e.g., the structure should not be regular and the inner angles of a triangle should be between 40°–90°), the value of θ is between −30–+30 and the length of line B is 0.5–1.5 times of that of line A.

Three identical triangles II can be defined from lines B, their adjacent lines A in the clockwise direction, and the angles (60-θ), in which the third sides of these triangles II are lines D. The two ends of line D are point 3 and point 2, while the three apexes of the triangle II are point 1, point 3, and point 2 (clockwise).

As seen in FIG. 5B, three points 4 are located on the three apexes of the large planar equilateral triangle, and three lines E are formed by connecting each of the points 4 to its adjacent point 3.

Referring now to FIG. 3, using the mass center of the spherical surface as a focal point, all the points on the large planar equilateral triangle are projected onto the large spherical equilateral triangle, whereby the corresponding spherical points 11, 12, 13, and 14 on the large spherical equilateral triangle respectively corresponding to the points 1, 2, 3, and 4 can be obtained, as shown in FIG. 3. Twenty sets of the large spherical equilateral triangles and their respective spherical points are formed on the spherical surface divided into twenty identical large spherical equilateral triangles.

The spherical point 15 of a large spherical equilateral triangle must overlap with the nearest spherical point 13 of a contiguous second large spherical equilateral triangle, therefore, locations of the three spherical points 15 of one large spherical equilateral triangle can be defined from the spherical points 13 of its three contiguous large spherical equilateral triangles.

From the above description, all the spherical points 11–15 of each of the elementary constructs of a spherical structure can be readily defined, and then the triangular elements of the elementary construct are formed by connecting the three apexes of each of these triangular elements. The three apexes of triangular element XI are points 11, 12, and 13, and its sides are A1, B1, and C1. The three apexes of triangular element XII are points 11, 12, and 13, too, while its sides are A1, B1, and D1. Triangular element XIII is an isosceles triangle having three apexes of points 13, 14, and 15 and three sides of E1, F1, and G1 wherein the lengths of E1 and G1 are identical. The three apexes of triangular element XIV are points 12, 13, and 15, and its sides are C1, F1, and H1. One elementary construct is composed of three triangular elements XI, three triangular elements XII, three triangular elements XIII, and three triangular elements XIV (i.e., twelve non-coplanar triangular elements). FIG. 5C shows the projective planar pattern of the elementary construct (shown in FIG. 3) and parts of its contiguous neighbors (shadowed areas), from which the geometric relationships of these components can be further illustrated. The corresponding triangles of triangular elements XI, XII, XIII, and XIV are triangle I, II, III, and IV, respectively. And the lines A, B, C, D, E, F, G, and H respectively correspond to lines A1, B1, C1, D1, E1, F1, G1, and H1.

When assembling a plurality of elementary constructs to form a spherical structure, the G1 of one elementary structure overlaps with the E1 of a contiguous elementary construct, and the H1 of the former overlaps with the D1 of the latter, and vice versa. A complete spherical structure can thus be constructed by assembling twenty elementary constructs, as seen in FIG. 1.

Although the present invention is illustrated using the description of a preferred embodiment, variations and modifications can easily be made by those skilled in the art. For example, a practical radome structure shown in FIG. 6 can be built by cutting off the lower portion of a spherical structure and adding a hoop like the base of the radome. Therefore, the scope of the present invention is intended to cover all the following claims.

What is claimed is:

1. An elementary construct for forming a spherical structure wherein said spherical structure is formed by assembling a plurality of said elementary constructs each of which is composed of three first triangular elements, three second triangular elements, three third triangular elements, and three fourth triangular elements, the geometry of said first, second, third, and fourth triangular elements being determined as follows:

dividing a spherical surface into twenty identical large spherical equilateral triangles, and defining a corresponding large planar equilateral triangle from the three apexes of one of said large spherical equilateral triangles;

defining the mass center of said large planar equilateral triangle as the first point and the midpoints of three side of said large planar equilateral triangle as the second points, and forming three first lines by connecting said first point with each of said second points;

using the first point as a rotary center, drawing three assistant lines by rotating said first lines with a (60+θ) angle in a first direction, locating a third point on each of said assistant lines with a predetermined distance to said first point, and forming three second lines by connecting said first point and each of said third points;

defining three identical first triangles, respectively, from one of said first lines, its corresponding said second line, and the angle (60+θ) therebetween, and defining the third side of said first triangle as a third line with the two ends of said third line being said second and third points;

defining three identical second triangles, respectively, from a said second line, its adjacent said first line in the first direction, and the angle (60-θ) therebetween, and defining the third side of said second triangle as a fourth line with the two ends of said fourth line being said second and third points;

defining the three apexes of said large planar equilateral triangle as the fourth points, and connecting each of said fourth points to its adjacent said third point so as to form three fifth lines;

using the mass center of said spherical surface as a focal point, and projecting said first point, second points, third points, fourth points, first lines, second lines, third lines, fourth lines, and fifth lines on said large planar equilateral triangle being projected onto said large spherical equilateral triangle, respectively, whereby obtaining corresponding first spherical point, second spherical points, third spherical points, fourth spherical points, first spherical chords, second spherical chords, third spherical chords, fourth spherical chords, and fifth spherical chords on said large spherical equilateral triangle; and thus forming twenty sets of said large spherical equilateral triangles and their respective spherical points and spherical chords on said spherical surface;

defining a fifth spherical point of each said large spherical equilateral triangle as being overlapped with the nearest third spherical point of the contiguous large spherical equilateral triangle, connecting said fifth spherical point to said third spherical point of said large spherical equilateral triangle forming a sixth spherical chord, connecting said fifth spherical point to said fourth spherical point of said large spherical equilateral triangle forming a seventh spherical chord, and connecting said fifth spherical point to said second spherical point of said large spherical equilateral triangle forming an eighth spherical chord, in which said seventh spherical chord of said large spherical equilateral triangle overlapping with the fifth spherical chord of said contiguous large spherical equilateral triangle, and said eighth spherical chord of said large spherical equilateral triangle overlapping with the fourth spherical chord of said contiguous large spherical equilateral triangle;

forming first, second, third, fourth, fifth, sixth, seventh, and eighth spatial lines by connecting the two ends of each of said first, second, third, fourth, fifth, sixth, seventh, and eighth spherical chords, respectively;

forming a said first triangular elements from a said first spatial line, a said second spatial line, and a said third spatial line which are connected to each other;

forming a said second triangular elements from a said first spatial line, a said second spatial line, and a said fourth spatial line which are connected to each other;

forming a said third triangular elements from a said fifth spatial line, a said sixth spatial line, and a said seventh spatial line which are connected to each other; and forming a said fourth triangular elements from a said third spatial line, a said sixth spatial line, and a said eighth spatial line which are connected to each other.

2. An elementary construct as described in claim 1 wherein the value of said θ is between −30°–+30°, and the length ratio between said second line and said first line is 0.5–1.5.

3. A method for forming a spherical structure using the elementary construct of claim 1, in which a plurality of said elementary constructs are regularly arranged on a spherical surface, each of the seventh spatial lines of said elementary construct overlapping with the fifth spatial line of contiguous elementary construct, and each of the eighth spatial lines of said elementary construct overlapping with the fourth spatial line of said contiguous elementary construct.

4. A spherical structure formed by the method of claim 3.

* * * * *